US006263178B1

(12) United States Patent
Takeyama et al.

(10) Patent No.: US 6,263,178 B1
(45) Date of Patent: Jul. 17, 2001

(54) METHOD OF APPLYING A BIAS VOLTAGE FOR IMAGE DEVELOPMENT AND METHOD OF SWITCHING THE BIAS VOLTAGE IN AN IMAGE FORMING APPARATUS

(75) Inventors: Yoshinobu Takeyama; Nobuyuki Yanagawa, both of Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/471,472

(22) Filed: Dec. 23, 1999

(30) Foreign Application Priority Data

Dec. 25, 1998 (JP) ..... 10-369716
Nov. 24, 1999 (JP) ..... 11-332881

(51) Int. Cl.[7] ..... G03G 15/01
(52) U.S. Cl. ..... 399/228; 399/235
(58) Field of Search ..... 399/179, 223, 399/228, 231, 235, 299, 306

(56) References Cited

U.S. PATENT DOCUMENTS 4,615,607 10/1986 Yanagawa et al. .
5,303,013 * 4/1994 Koike et al. ..... 399/302
5,376,998 * 12/1994 Suzuki ..... 399/88
5,627,722 * 5/1997 Hirst ..... 361/170
5,740,493 * 4/1998 Otaki et al. ..... 399/71
5,862,438 * 1/1999 Folkins ..... 399/88
6,029,033 * 2/2000 Kawasaki et al. ..... 399/149

FOREIGN PATENT DOCUMENTS 62-212673 * 9/1987 (JP) .

* cited by examiner

*Primary Examiner*—Robert Beatty
(74) *Attorney, Agent, or Firm*—Oblon, Spivak, McClelland, Maier & Neustadt, P.C.

(57) ABSTRACT

An image forming apparatus includes a plurality of image forming units each including a single image carrier, a single writing device and a plurality of developing means each including a single developing roller for developing a latent image formed on the image carrier by the writing device with a developer to thereby produce a toner image. The image forming units are spaced by a preselected distance along the same surface of an intermediate image transfer belt to which the toner image is to be transferred from the image carrier. A selecting device causes the developing means to selectively perform development. A single bias power source applies a bias voltage for development to the developing means. A bias switching device applies the bias voltage output from the bias power source to one of the developing means selected by the selecting device according to the outputs of sensors respectively included in the image forming units.

18 Claims, 9 Drawing Sheets

START
S101
DRIVE DRUM, BELT & DEVELOPING ROLLER
S103
SWITCH DEVELOPING SECTION
S102
VALID DEVELOPING SECTION ?
N
Y
S104
APPLY BIAS VOLTAGE TO VALID DEVELOPING SECTION
WRITING
S105
S106
TO END WRITING ?
N
Y
S107
END WRITING
S108
TURN OFF BIAS POWER SOURCE
S109
TO SWITCH ANOTHER VALID DEVELOPING SECTION ?
Y
N
S110
TO CONTINUE WRITING ?
Y
N
S111
STOP DRIVING DRUM, BELT & DEVELOPING ROLLER
END

| FIG.8A |
| --- |
| FIG.8B |

METHOD OF APPLYING A BIAS VOLTAGE FOR IMAGE DEVELOPMENT AND METHOD OF SWITCHING THE BIAS VOLTAGE IN AN IMAGE FORMING APPARATUS

BACKGROUND OF THE INVENTION

1. Field of the Invention

The present invention relates to an electrophotographic copier, printer, facsimile apparatus or similar image forming apparatus and more particularly to a method of applying a bias voltage for development and a method of switching it in an image forming apparatus.

2. Discussion of the Background

A color image forming apparatus of the type including two image forming units is conventional. The image forming units are spaced from each other by a preselected distance along the same running surface of an intermediate image transfer belt. Each image forming unit includes a single photoconductive element and a plurality of developing sections each for developing a particular latent image formed on the drum with toner of particular color. This type of image forming apparatus is disclosed in, e.g., Japanese Patent Laid-Open Publication No. 10-177286.

The above conventional color image forming apparatus has some problems left unsolved, as follows. In each image forming unit, a plurality of developing sections each develops a particular latent image formed on a single photoconductive drum with toner of particular color in contact with the drum, as stated above. It is therefore necessary to prevent toner of different colors from being mixed by selectively rendering the toner of different colors inoperative by sophisticated control. Moreover, a particular bias voltage for development is assigned to each of developing rollers included in the developing sections. This scales up a bias power source and therefore increases the overall size of the apparatus.

SUMMARY OF THE INVENTION

An image forming apparatus of the present invention includes a plurality of image forming units each including a single image carrier, a single writing device and a plurality of developing means each including a single developing roller for developing a latent image formed on the image carrier by the writing device with a developer to thereby produce a toner image. The image forming units are spaced by a preselected distance along the same surface of an intermediate image transfer belt to which the toner image is to be transferred from the image carrier. A selecting device causes the developing means to selectively perform development. A single bias power source applies a bias voltage for development to the developing means. A bias switching device applies the bias voltage output from the bias power source to one of the developing means selected by the selecting device.

It is therefore an object of the present invention to provide a bias applying method and a bias switching method for an image forming apparatus of the type including two image forming units capable of obviating the sophisticated control over the condition of toner and thereby reducing the overall size of the apparatus.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
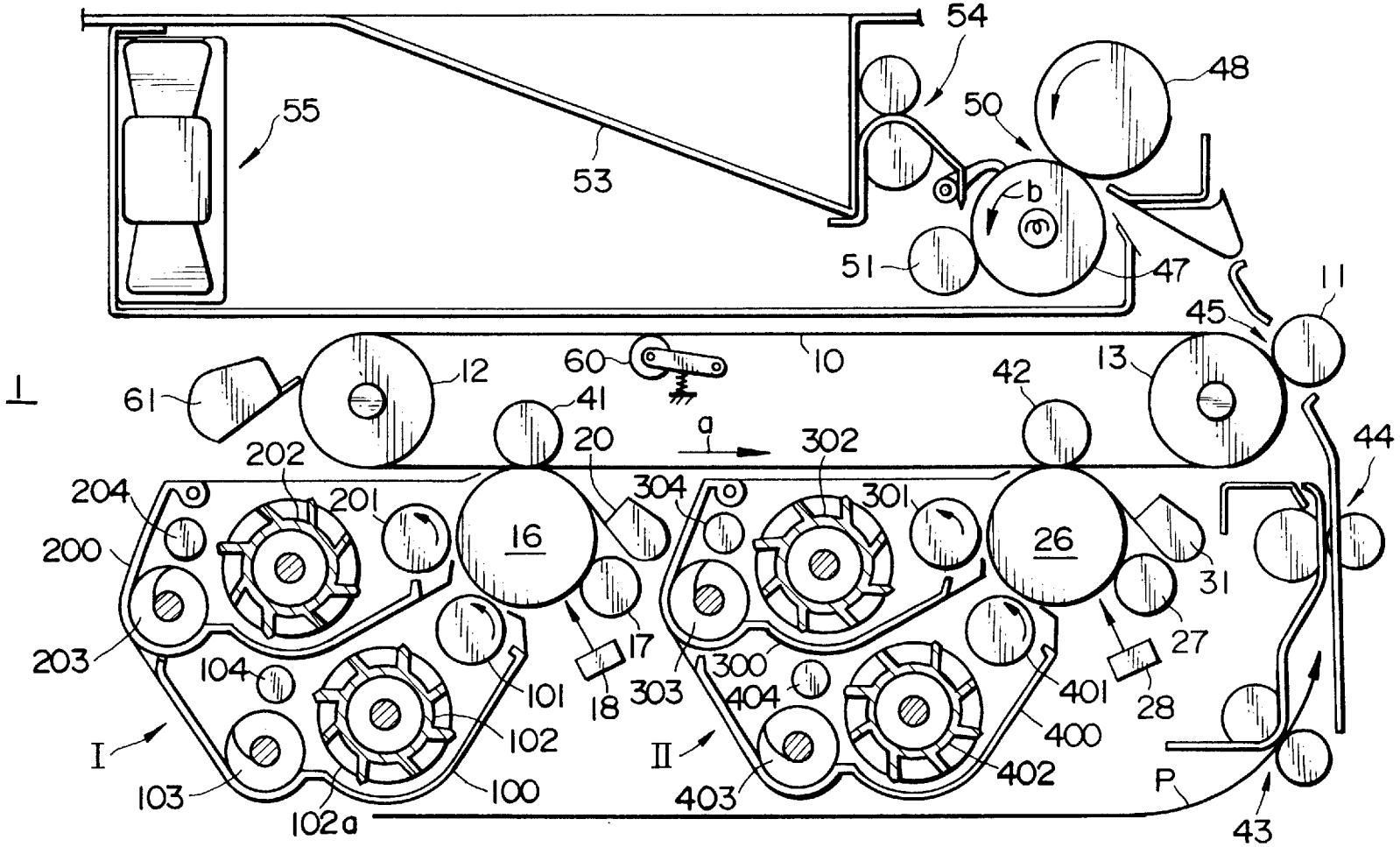
FIG. 1 PRIOR ART
FIG. 1 is side elevation showing a conventional color image forming apparatus of the type including two image forming units.

Referring now to the drawings, wherein like reference numerals designate identical or corresponding parts throughout the several views, and more particularly to FIGS. 3–8 thereof, there is illustrated an embodiment of the present invention, as will be further described in detail.

To better understand the present invention, reference will be made to a conventional color image forming apparatus of the type including two image forming units, shown in FIG. 1. As shown, the apparatus, generally 1, includes a first and a second image forming unit I and II, respectively. An intermediate image transfer belt 10 is passed over a drive roller 12 and a driven roller 13. The two image forming units I and II are positioned below the belt 10 and spaced from each other by a preselected distance. The drive roller 12 causes the belt 10 to run in a direction indicated by an arrow a in FIG. 1. A tension roller 60 applies an optimal tension to the belt 10. The circumferential length of the belt 10 is greater than the maximum paper size, as measured in the direction of movement, available with the apparatus 1 by the length of a non-image region.

The first image forming unit I includes a charger 17 for uniformly charging the surface of a photoconductive drum or image carrier 16, writing means 18 for scanning the charged surface of the drum 16 with a beam modulated in accordance with an image signal based on a document, a first-color developing section 100, a third-color developing section 200, and drum cleaning means 20.

The first-color developing section 100 includes a developing roller 101, a paddle roller 102, a screw conveyor 103, and an opening 104 for toner replenishment. The paddle roller 102 has a screw-like fin 102*a* and is rotatable in one direction to convey a developer stored in the developing section 100 while agitating it. This developer is fed to the developing roller 101. The screw conveyor 103 conveys the developer stored in the developing section 100 in the direction opposite to the direction of conveyance of the paddle roller 102. As a result, the developer in the developing section 100 is fed to the developing roller 101 in a sufficiently agitated condition. A toner container, not shown, is removably positioned at the opening 104 for replenishing toner of first color to one end of the screw conveyor 103 at an adequate timing, thereby maintaining the toner content of the above developer constant.

The third-color developing section 200 is identical in configuration and function with the first-color developing section 100 and includes a developing roller 201, a paddle roller 202, a screw conveyor 203, and an opening 203 for toner replenishment.

Figure 2:
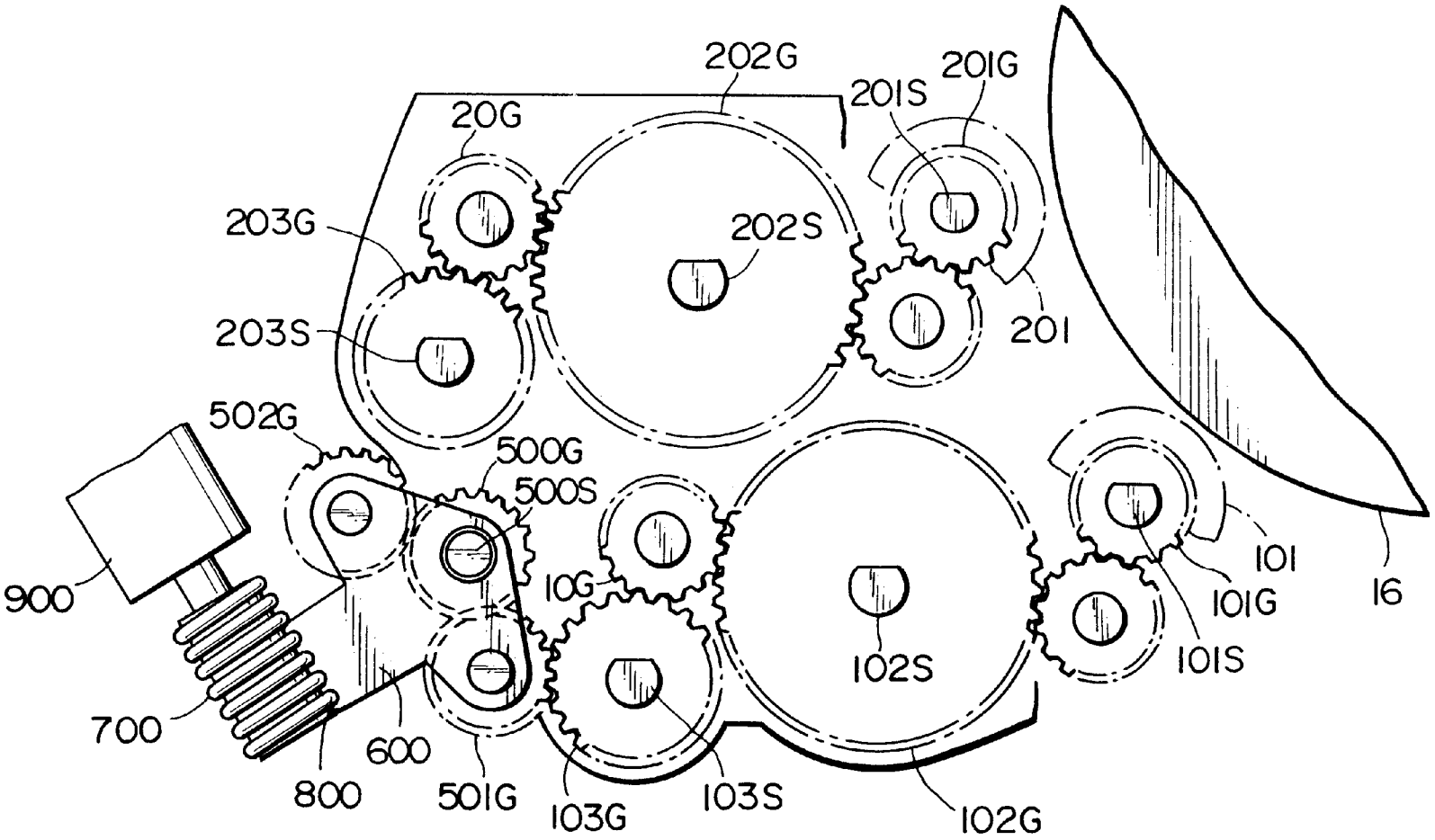
FIG. 2 PRIOR ART
FIG. 2 is a fragmentary side elevation showing a rotation transmission mechanism included in the conventional apparatus.

As shown in FIG. 2, gears 102G and 103G are respectively affixed to the shafts 102S and 103S of the paddle roller 102 and screw conveyor 103 at the outside of one end wall of the developing section 100. The gears 102G and 103G are held in mesh with an intermediate idle gear 10G. Likewise, gears 102G and 101G affixed to the shafts 102S and 101S of the paddle roller 102 and developing roller 101, respectively, are held in mesh with an intermediate idle gear. In the third-color developing section 200, gears 202G and 202G affixed to the shafts 202A and 203S of the paddle roller 202 and screw conveyor 203, respectively, are held in mesh with an intermediate idle gear 20G. Gears 202G and 201G affixed to the paddle roller 202 and developing roller 201, respectively, are held in mesh with an intermediate idle gear.

When a motor or drive source, not shown, drives the gears 104G and 203G, the developing rollers 101 and 201, respectively, are caused to rotate in a direction indicated by an arrow in FIG. 1. More specifically, as shown in FIG. 2, a drive shaft 500S is connected to the output shaft of the motor labeled 900. A drive gear 500G is affixed to the drive shaft 500S and held in mesh with switching gears 501G and 502G. The switching gears 501G and 502G are mounted on a switching plate 600 that is pivotable about the drive shaft 500S. The switching plate 600 is therefore angularly movable about the drive shaft 500S to bring either one of the switching gears 501G and 502G into mesh with the gear 104G or 203G, respectively, so that the developing roller 101 or 201 is rotated. In FIG. 2, the switching gear 501G is shown as meshing with the gear 103G, causing the developing roller 101 to rotate in the direction indicated by the arrow in FIG. 1. A worm 700 is mounted on the output shaft of the motor 900 while the switching plate 600 is formed with a worm gear 800 meshing with the worm 700. The motor 700 reversibly rotates the worm 700 and thereby causes the switching plate 600 to move about the drive shaft 500S.

Referring again to FIG. 1, the second image forming unit II, like the first image forming unit I, includes a photoconductive drum or image carrier 26, a charger 27, writing means 28, a second-color developing section 300, a fourth-color developing section 400, and drum cleaning means 31. The second image forming unit II is mounted on the apparatus body in the same orientation as the first image forming unit I. The image forming unit II also includes a rotation transmission mechanism described above in relation to the image forming apparatus I.

The image forming units I and II are removably mounted on the apparatus body. The drums 16 and 26 are rotatable in synchronism with the movement of the belt 10, and each has a peripheral speed precisely coincident with the running speed of the belt 10. The chargers 17 and 27 may be replaced with corona chargers or brush chargers.

A first and a second image transfer roller 41 and 42 face the drums 16 and 26, respectively, with the intermediary of the belt 10 and are movable toward and away from the drums 16 and 26. The image transfer rollers 41 and 42 each are applied with a bias voltage for image transfer. An image transfer roller 11 is movable toward and away from the driven roller 13 with the intermediary of the belt 10 and applied with a bias voltage for image transfer to a paper or similar recording medium P. The drums 16 and 26 positioned below the belt 10 are slightly spaced form the belt 10 while the transfer rollers 41 and 42 are spaced above the belt 10. When toner images formed on the drums 16 and 26 are to be transferred to the belt 10, the image transfer roller 41 and/or the image transfer roller 42 causes the belt 10 to contact the drum 16 and/or the drum 26. The driven roller 13 and image transfer roller 11 define an image transfer station 45. The image transfer rollers 41 and 42 may be replaced with corona chargers or brush chargers. A cleaning unit 61 is movable into and out of contact with the belt 10 for removing toner left on the belt 10 after image transfer.

A paper feeder, not shown, is located below the image forming units I and II for feeding papers to the right, as viewed in FIG. 1, one by one. The paper P fed from the paper feeder is conveyed to the image transfer station 45 by a feed roller pair 43 and a registration roller pair 44. A fixing unit 50 is positioned obliquely above the image transfer station 45 and includes a heat roller 47 rotatable in a direction b and a press roller 48 pressed against the heat roller 47. A roller 51 for applying an anti-offset liquid to the surface of the heat roller 47 is brought into contact with the heat roller 47 at a preselected timing.

An outlet roller pair 54 is positioned downstream of the fixing unit 50 for discharging the paper P coming out of the fixing unit 50 onto a tray 53. An exhaust fan 55 is positioned in the upper right portion of FIG. 1 for preventing electrical parts, not shown, arranged below the tray 53 from being heated by their own heat and the heat of the fixing unit 50.

In operation, the charger 18 and first-color developing section 100 electrostatically form a latent image on the drum 16 of the first image forming unit I. The developing roller or developer carrier 101 included in the first-color developing section 100 accommodates a plurality of stationary magnets or magnetic field generating means therein. Also, a blade is provided for regulating the amount and height of the developer deposited on the developing roller 101. The blade and magnets form a magnet brush on the developing roller 101. The developing roller 101 rotating in the forward direction develops the latent image formed on the drum 16 and thereby produces a toner image of first color. The image transfer roller 41 transfers the toner image from the drum 16 to the belt 10. After the development, the developer on the developing roller 101 is brought to an inoperative position. While the belt 10 conveys the above toner image of first color toward the second image forming unit II, the charger 27 and writing means 28 of the second image forming unit II form a latent image on the drum 26. The second-color developing section 300 develops the latent image of the drum 26 to thereby produce a toner image of second color. The toner image of second color is transferred from the drum 26 to the belt 10 by the image transfer roller 42 over the toner image of first color existing on the belt 10. The developer deposited on the roller 201 is then brought into an inoperative position in the same manner as the developer deposited on the roller 101.

While the belt 10 conveys the composite toner image of first and second colors toward the first image forming unit I, the charger 17 and 18 form a latent image for the third-color developing section 200. The third-color developing section 200 develops the latent image to thereby produce a toner image of third color. The transfer roller 41 transfers the toner image of third color to the belt 10 over the composite toner image existing on the belt 10. Further, while the belt 10 convey the resulting composite image of first, second and third colors toward the second image forming unit II, the charger 27 and writing means 28 form a latent image on the drum 26 for the fourth-color developing section 400. The fourth-color developing section 400 develops the latent image to thereby produce a toner image of fourth color on the drum 26. The image transfer roller 42 transfers the toner image from the drum 26 to the belt 10 over the composition toner image of first, second and third colors existing on the belt 10, thereby completing a full-color toner image. The developers deposited on the rollers 301 and 401 each are brought to an inoperative position in the same manner.

When the full-color image is about to be completed on the belt 10 by the image transfer roller 42, the paper P fed from the paper feeder is conveyed to the image transfer station 45 by the registration roller pair 44. As a result, the full-color image is transferred from the belt 10 to the paper P. The toner image on the paper P is fixed by the fixing unit 50. Thereafter, the paper or printing P with the toner image is driven out to the tray 53 by the outlet roller pair 54. After the image transfer, the cleaning unit 61 removes toner left on the belt 10. In a repeat copy mode, when the second image transfer unit II transfers the toner image of first and third colors to the belt 10, the first image forming unit I begins to transfer another toner image of first color to the belt 10.

The above conventional image forming apparatus has some problems left unsolved, as stated earlier.

Figure 3:
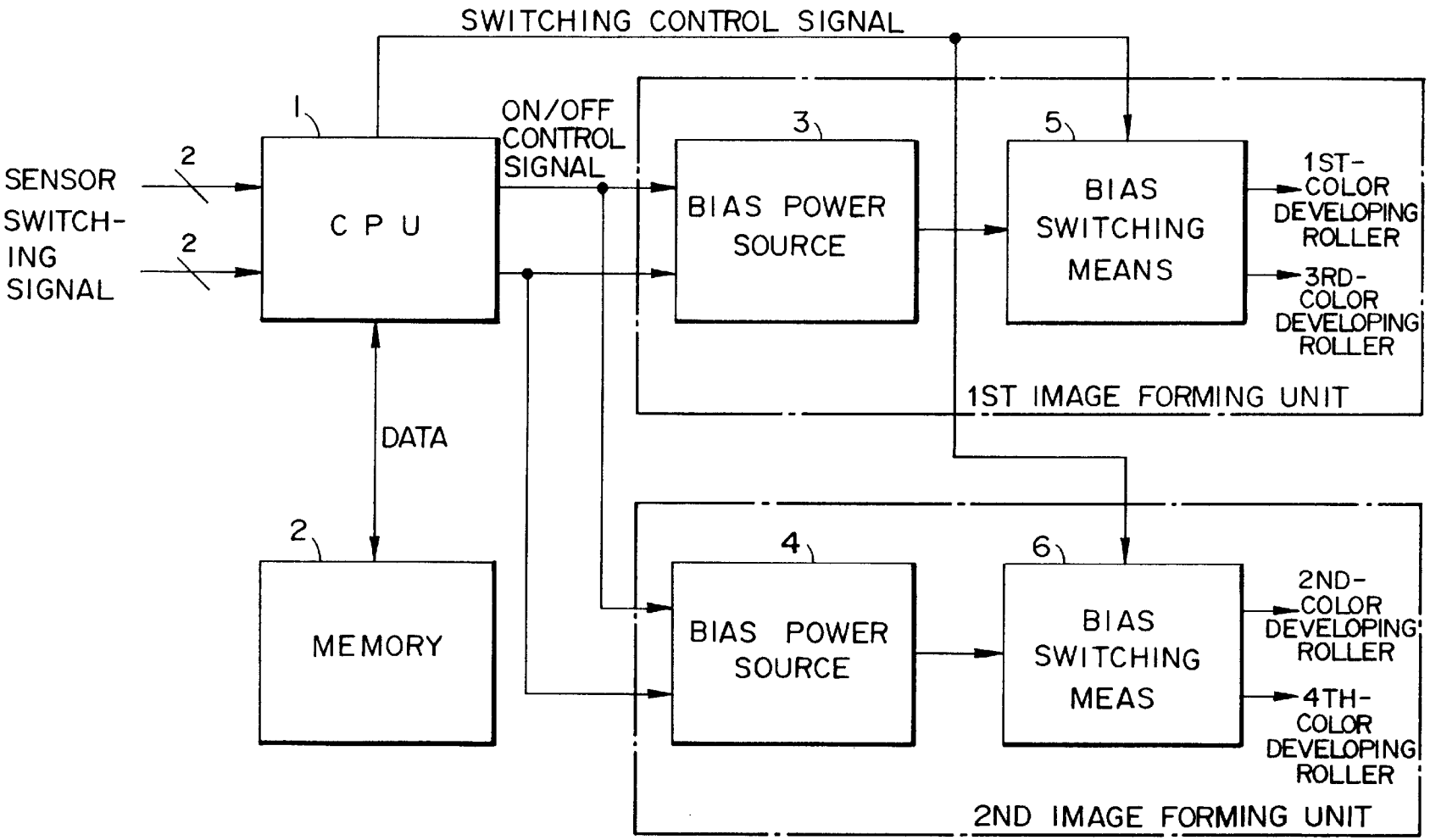
FIG. 3 is a block diagram schematically showing a bias voltage applying device embodying the present invention and included in an image forming apparatus.
Figure 4:
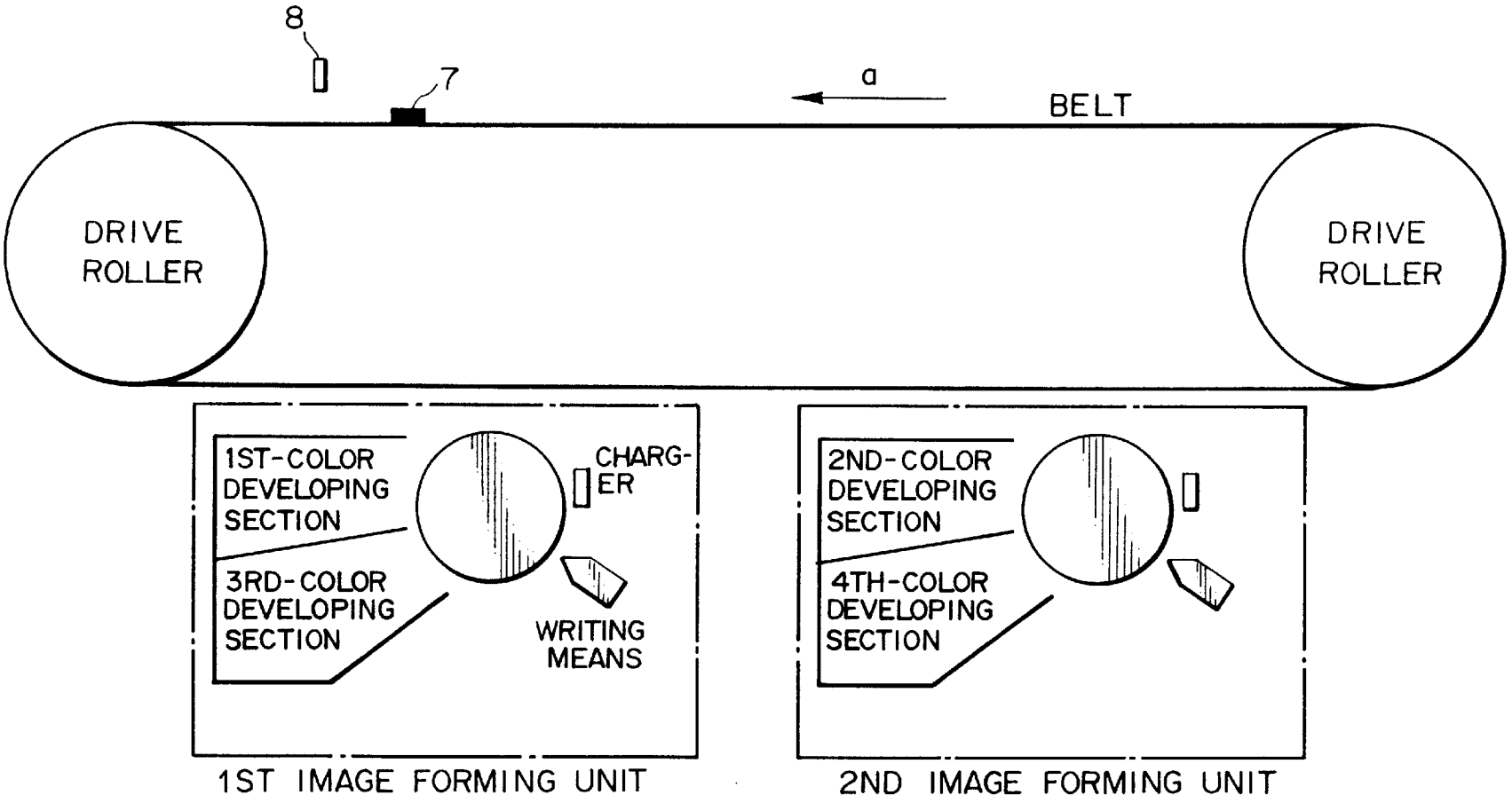
FIG. 4 is a view showing an arrangement for development included in the illustrative embodiment.

Referring to FIG. 3, a bias voltage applying device embodying the present invention is shown. FIG. 4 shows the general configuration of an image forming apparatus including the voltage applying device. As shown in FIG. 4, the image forming apparatus includes a first and a second image forming unit.

As shown in FIG. 3, the bias voltage applying device includes a CPU (Central Processing Unit) 1. As shown in FIG. 4, a sensor 8 senses a mark 7 provided on an intermediate image transfer belt. The two image forming units shown in FIG. 3 each include a respective sensor responsive to the switching of developing sections each being assigned to a particular color. In response to the output of the sensor 8 and the outputs of the sensors of the image forming units, the CPU 1 selectively turns on or turns off bias power sources 3 and 4 and controls bias switching means 5 and 6 in accordance with data stored in a memory 2 beforehand. Specifically, the memory 2 stores color information and other developing conditions assigned to the respective developing sections, data relating to bias voltages each being assigned to the developing roller of a particular developing section, data relating to the frequency of an AC bias, and data relating to the switching timing of the bias switching means 5 and 6. The bias power sources 3 and 4 are respectively assigned to the first and second image forming units. The bias switching means 5 and 6 respectively switch the application of bias voltages to the developing rollers of the developing sections associated therewith.

The bias switching means 5 and 6 each are implemented by a power relay. A particular sensor switching signal is assigned to the two developing sections of each image forming unit and is used to inform the CPU 1 of a valid/invalid state. When the sensor switching signal has two bits, i.e., when it is implemented by two sensors, a switching operation is determined to have ended when the sensor output is (1, 0) or (0, 1). When the sensor has a single bit, i.e., when use is made of a single sensor responsive to the displacement (switching) of a switching mechanism (pivotable gear), the steps of a stepping motor for driving selecting means which selects development are counted so as to detect switching between two developing means on the basis of the output of the sensor. More specifically, in each image forming unit, the stepping motor is reversed by a preselected number of steps after the turn-on of the sensor in order to displace the switching mechanism or pivotable gear by a preselected amount. As a result, drive transmission is switched from one developing section to the other developing section. In this manner, switching between two image forming sections in each image forming unit is detected on the basis of the ON/OFF of the sensor, i.e., a one-bit sensor switching signal. Further, the CPU 1 determines the above switching on the basis of color information included in image data and controls the ON/OFF of the bias power source while setting a particular bias voltage.

Figure 5:
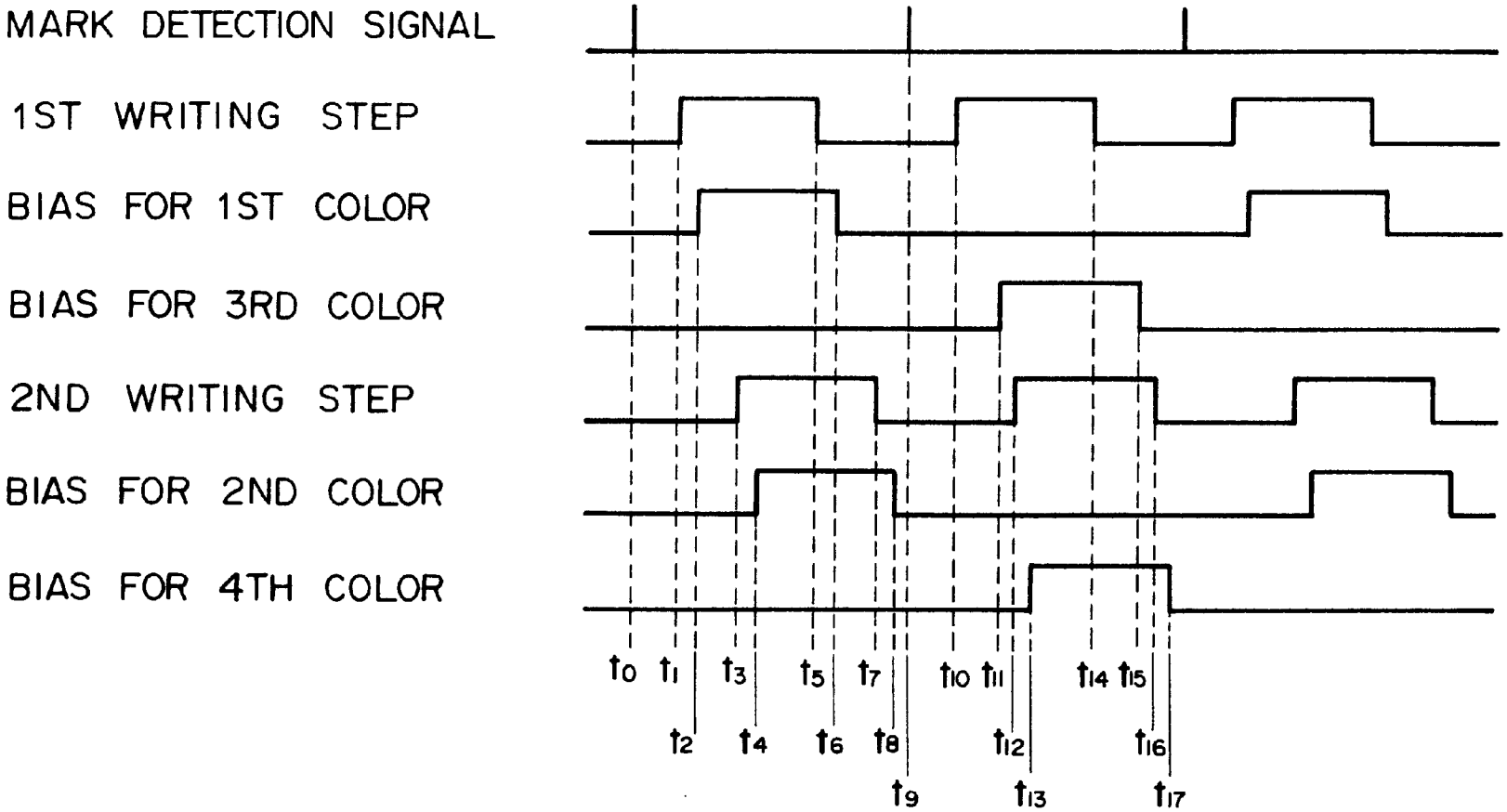
FIG. 5 is a timing chart demonstrating the application of bias voltages for development to occur in the illustrative embodiment.
Figure 6:
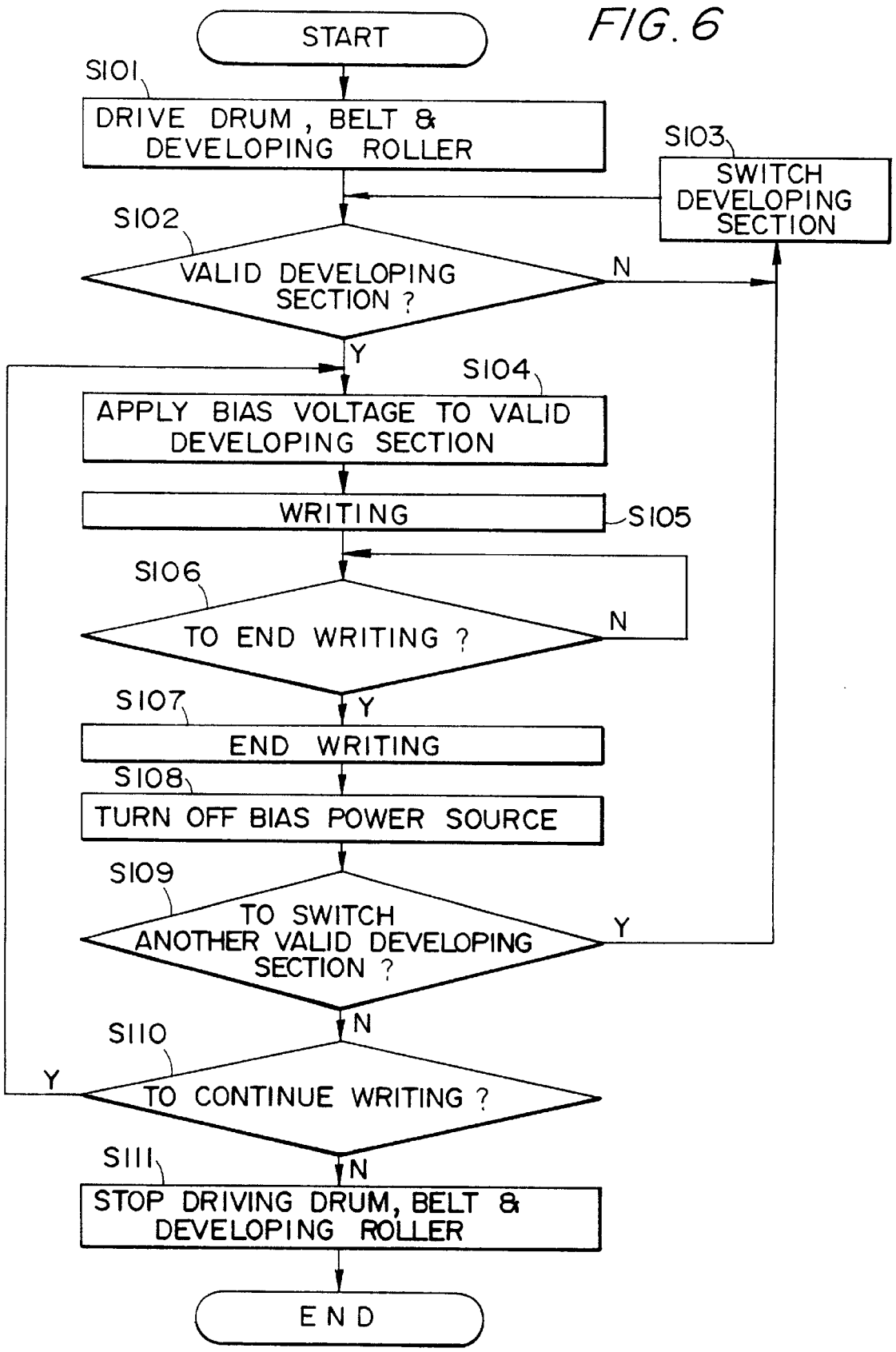
FIG. 6 is a flowchart showing a specific bias voltage application procedure available with the illustrative embodiment.

A specific operation of the illustrative embodiment will be described with reference to FIGS. 5 and 6 as well as to FIGS. 3 and 4. It is to be noted that FIG. 6 pertains to bias application to be effected in one of the two image forming units.

First, the sensor 8 senses the mark 7 of the image transfer belt at a time $t_0$ and sends a mark detection signal to the CPU 1. In response, the CPU 1 outputs a command for driving the photoconductive drum, intermediate image transfer belt and developing roller to be driven (step S101). The CPU 1 then reads data relating to a bias voltage assigned to the developing roller of a first-color developing section, e.g., color information and other developing conditions out of the memory 2 and determines, based on the data, whether or not the first-color developing section being driven is valid (steps S102 and S103). If the first-color developing section is valid, the CPU 1 turns on the bias power source 3 and commands it to output a first-color bias voltage assigned to the first-color developing section (step S104).

When a first writing step to be executed by the first image forming unit begins at a time $t_1$, the CPU 1 turns on the bias application to the first-color developing section at a time $t_2$. On the elapse of a period of time corresponding to the duration of development, the first writing step ends at a time $t_5$. Subsequently, the bias application to the first-color developing section is interrupted (steps S105 through S108). The CPU 1 determines whether or not the first-color developing section should be replaced with another valid developing section (step S109). If the answer of the step S109 is positive (YES), the CPU 1 switches the first-color developing section to a third-color developing section (step S103). If the answer of the step S109 is negative (NO), the CPU 1 determines whether or not the writing operation should be continued (step S110). If the answer of the step S110 is YES, the CPU 1 again turns on the bias application to the first-color developing section after the sensor 8 has sensed the mark 7 (steps S104 through S108). If the answer of the step S110 is NO, the CPU 1 stops the drive of the drum, belt, and developing roller (step S111).

Also, the CPU 1 reads data relating to a bias voltages assigned to the developing roller of a second-color developing section, e.g., color information and other developing conditions out of the memory 2 and determines, based on the data, whether or not the second-color developing section being driven is valid (steps S102 and S103). If the second-color developing section is valid, then the CPU 1 turns on the bias power source 4 and commands it to output a second-color bias voltage assigned to the second-color developing section (step S104). When a second writing step to be executed by the second image forming unit begins at a time $t_3$, the CPU 1 turns on the bias assigned to the second-color developing section at a time $t_4$. On the elapse of a period of time corresponding to the duration of development, the second writing step ends at a time $t_7$. Subsequently, the CPU 1 interrupts the bias application to the second-color developing section at a time $t_8$ (steps S102 through S108).

After the above step S108, the CPU 1 determines whether or not the second-color developing section should be replaced with another valid developing section (step S109). If the answer of the step S109 is YES, the CPU 1 replaces the second-color developing section with a fourth-color developing section at a time $t_{11}$ (step S103). If the answer of the step S109 is NO, the CPU 1 determines whether or not the writing operation should be continued (step S110). If the answer of the step S110 is YES, the CPU 1 again turns on the bias application to the second-color developing section after the sensor 8 has sensed the mark 7 (steps S104 through S108). If the answer of the step S110 is NO, the CPU 1 stops the drive of the drum, belt, and developing roller (step S111).

The sensor 8 senses the mark 7 of the belt at a time $t_8$. In response to the resulting output of the sensor 8, the CPU 1 outputs a command for driving the photoconductive drum, intermediate image transfer belt and developing roller to be driven (step S101). The CPU 1 then reads data relating to a bias voltage assigned to the developing roller of a third-color developing section, e.g., color information and other developing conditions out of the memory 2 and determines, based on the data, whether or not the third-color developing section being driven is valid (steps S102 and S103). If the third-color developing section is valid, the CPU 1 turns on the bias power source 3 and commands it to output a third-color bias voltage assigned to the third-color developing section (step S104).

When the first writing step to be executed by the first image forming unit begins at a time $t_{10}$, the CPU 1 turns on the bias application to the third-color developing section at a time $t_{11}$. On the elapse of a period of time corresponding to the duration of development, the first writing step ends at a time $t_{14}$. Subsequently, the CPU 1 interrupts the bias application of the third-color developing section at a time $t_{15}$ (steps S105 through S108). The CPU 1 determines whether or not the third-color developing section should be replaced with another valid developing section (step S109). If the answer of the step S109 is YES, the CPU 1 switches the third-color developing section to the first-color developing section at a time $t_{11}$ (step S103). If the answer of the step S109 is NO, the CPU 1 determines whether or not the writing operation should be continued (step S110). If the answer of the step S110 is YES, the CPU 1 again turns on the bias application to the third-color developing section after the sensor 8 has sensed the mark 7 (steps S104 through S108). If the answer of the step S110 is NO, the CPU 1 stops the drive of the drum, belt, and developing roller (step S111).

Further, the CPU 1 reads data relating to a bias voltage assigned to the developing roller of the fourth-color developing section, e.g., color information and other developing conditions out of the memory 2 and determines, based on the data, whether or not the fourth-color developing section being driven is valid (steps S102 and S103). If the fourth-color developing section is valid, then the CPU 1 turns on the bias power source 4 and commands it to output a fourth-color bias voltage assigned to the fourth-color developing section (step S104). When the second writing step of the second image forming unit begins at a time $t_{12}$, the CPU 1 turns on the bias application to the fourth-color developing section at a time $t_{13}$. Subsequently, when the second writing step ends at a time $t_{16}$ on the elapse of the period of time corresponding to the duration of development, the CPU 1 interrupts the bias application to the fourth-color developing unit (steps S102 through S108).

Subsequently, the CPU 1 determines whether or not the fourth-color developing section should be replaced with another valid developing section (step S109). If the answer of the step S109 is YES, the CPU 1 switches the fourth-color developing section to the second-color developing section at a time $t_{11}$ (step S103). If the answer of the step S109 is NO, the CPU 1 determines whether or not the writing operation should be continued (step S110). If the answer of the step S110 is YES, the CPU 1 again turns on the bias application to the fourth-color developing section after the sensor 8 has sensed the mark 7 (steps S104 to S108). If the answer of the step S110 is NO, the CPU 1 stops the drive of the drum, belt, and developing roller (step S111). By the above procedure, development in the first color to the fourth color is completed.

Figure 7:
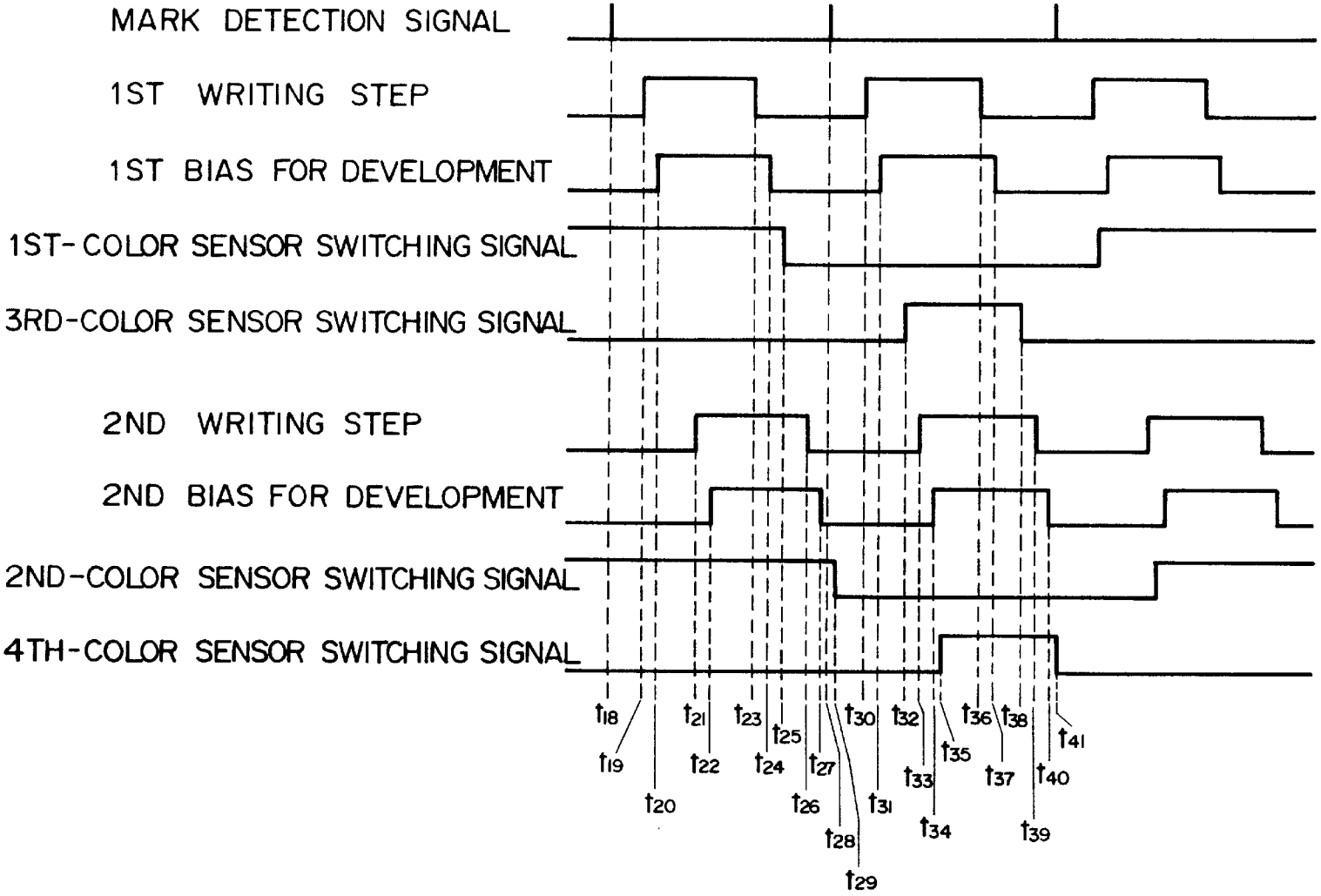
FIG. 7 is a timing chart showing the switching of the bias voltages to occur in the illustrative embodiment.
Figures 8, 8A:
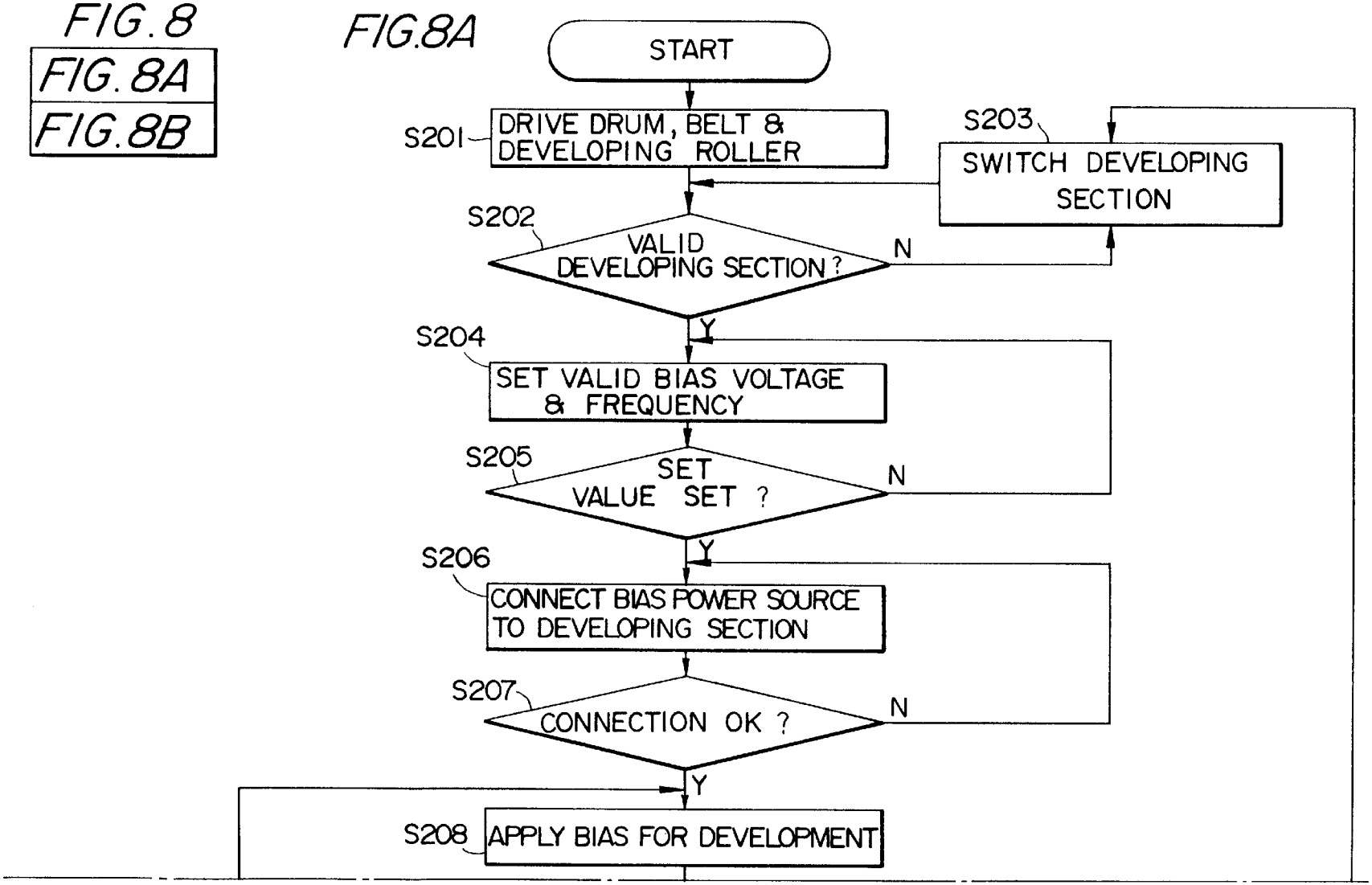
FIG. 8 is a flowchart showing a specific bias voltage switching procedure also available with the illustrative embodiment.
Figure 8B:
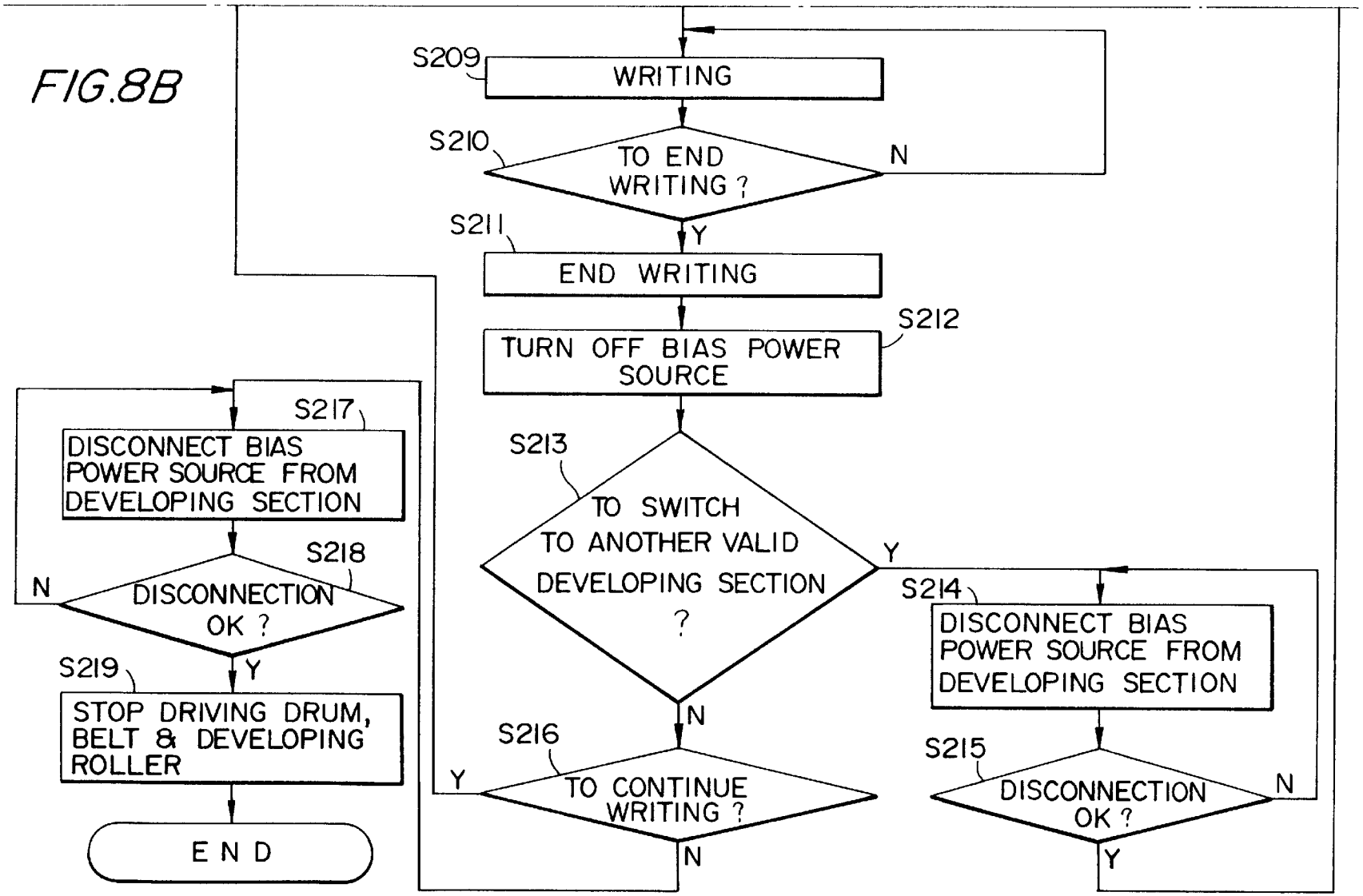

Reference will be made to FIGS. 7 and 8 for describing the operation of the illustrative embodiment with attention paid to the switching means 5 and 6. It is to be noted that FIG. 8 pertains to the switching of the bias voltages to be executed in one of the two image forming units.

First, the sensor 8 senses the mark 7 of the belt, FIG. 4, at a time $t_{18}$ and sends a mark detection signal to the CPU 1. In response, the CPU 1 outputs a command for driving the drum, belt, and developing roller (step S201). The CPU 1 reads data relating to the first-color bias voltage assigned to the developing roller of the first-color developing section, e.g., the color information and other developing conditions out of the memory 2 and determines, based on the data, whether or not the developing section being driven is valid (steps S202 and S203). If the first-color developing section is valid (YES, step S202), the CPU 1 sets the bias voltage and frequency assigned to the first-color developing section (step S204) and then determines whether or not they are adequate (step S205). If the answer of the step S205 is YES, the CPU 1 connects the bias voltage source 3 to the first-color developing section (steps S206 and S207).

When the first writing step of the first image forming unit begins at a time $t_{18}$, the CPU 1 turns on the bias application to the first-color developing section at a time $t_{20}$. When the first writing step ends at a time $t_{23}$ on the elapse of the period of time corresponding to the duration of development, the CPU 1 turns off the bias application for the first-color developing section at a time $t_{24}$. Then, at a time $t_{25}$, the CPU 1 invalidates the operation of the first-color developing section and turns off the first color sensor switching signal (steps S208 through S212). Subsequently, the CPU 1 determines whether or not the first-color developing section should be replaced with another valid developing section (step S213). If the answer of the step S213 is YES, the CPU 1 disconnects the bias power source 3 from the first-color developing section in order to interrupt the bias application to the developing section (steps S214) and S215).

Subsequently, the CPU 1 switches the first-color developing section to the third-color developing section. The CPU 1 reads data relating to the third-color bias voltage assigned to the developing roller of the third-color developing section, e.g., the color information and other developing conditions out of the memory 2, sets, based on the data, the bias voltage and frequency assigned to the third-color developing section, and then determines whether or not they are adequate (steps S204 and S205). If the answer of the step S205 is YES, the CPU 1 connects the bias voltage source 3 to the third-color developing section (steps S206 and S207).

If the answer of the step S213 is NO, the CPU 1 determines whether or not the writing operation should be continued (step S216). If the answer of the step S216 is YES, the CPU 1 again sets up the bias application to the first-color developing section after the sensor 8 has sensed the mark 7 (steps S208 through S212). If the answer of the step S216 is NO, the CPU 1 disconnects the bias power source 3 from the first-color developing section (steps S217 and S218) while stopping the drive of the drum, belt, and developing roller.

Also, the CPU 1 reads data relating to the second-color bias voltage assigned to the developing roller of the second-color developing section, e.g., the color information and other developing conditions out of the memory 2 and determines, based on the data, whether or not the developing section being driven is valid (steps S202 and S203). If the answer of the step 202 is YES, the CPU 1 sets the bias voltage and frequency assigned to the second-color developing section and then determines whether or not they are adequate (steps S204 and S205). Subsequently, the CPU 1 connects the bias power source 4 to the second-color developing section (steps S206 and S207). When the second writing step of the second image forming unit begins at a time $t_{21}$, the CPU 1 turns on the bias application to the second-color developing section at a time $t_{22}$. When the second writing step ends at a time $t_{26}$ on the elapse of the period of time corresponding to the duration of development, the CPU 1 interrupts the bias application to the second-color developing section. At a time $t_{28}$, the CPU 1 invalidates the operation of the second-color developing section and turns off the second-color sensor switching signal (steps S208 through S212). Thereafter, the CPU 1 determines whether or not the second-color developing section should be replaced with another valid developing section (step S213). If the second-color switching section should be switched to the fourth-color developing section, the CPU 1 disconnects the bias power source 4 from the second-color developing section (steps S214 and S215).

Subsequently, the CPU 1 switches the second-color developing section to the fourth-color developing section. The CPU 1 reads data relating to the fourth-color bias voltage assigned to the developing roller of the fourth-color developing section, e.g., the color information and other developing conditions out of the memory 2, sets, based on the data, the bias voltage and frequency assigned to the fourth-color developing section, and then determines whether or not they are adequate (steps S204 and S205). If the answer of the step S205 is YES, the CPU 1 connects the bias voltage source 4 to the fourth-color developing section (steps S206 and S207). If the answer of the step S213 is NO, the CPU 1 determines whether or not the writing operation should be continued (step S216). If the answer of the step S216 is YES, the CPU 1 again sets up the bias application to the second-color developing section after the sensor 8 has sensed the mark 7 (steps 208 through S212). If the answer of the step S216 is NO, the CPU 1 disconnects the bias power source 4 from the second-color developing section (steps S217 and S218) while stopping the drive of the drum, belt, and developing roller (step S219).

The sensor 8 senses the mark 7 of the belt, FIG. 4, at a time $t_{28}$ and sends a mark detection signal to the CPU 1. In response, the CPU 1 outputs a drive command meant for the drum, belt, and developing roller (step S201). The CPU 1 reads data relating to the third-color bias voltage assigned to the developing roller of the third-color developing section, e.g., the color information and other developing conditions out of the memory 2 and determines, based on the data, whether or not the developing section being driven is valid (steps S202 and S203). If the third-color developing section is valid (YES, step S202), the CPU 1 sets the bias voltage and frequency assigned to the third-color developing section (step S204) and then determines whether or not they are adequate (step S205). If the answer of the step S205 is YES, the CPU 1 connects the bias voltage source 3 to the third-color developing section (steps S206 and S207).

When the first writing step of the first image forming unit begins at a time $t_{30}$, the CPU 1 turns on the bias application to the third-color developing section at a time $t_{31}$. When the first writing step ends at a time $t_{36}$ on the elapse of the period of time corresponding to the duration of development, the CPU 1 interrupts the bias application to the third-color developing section a time $t_{37}$. Then, at a time $t_{38}$, the CPU 1 invalidates the operation of the third-color developing section and turns off the third color sensor switching signal (steps S208 through S212). Subsequently, the CPU 1 determines whether or not the third-color developing section should be replaced with another valid developing section (step S213). If the third-color developing section should be replaced with the first-color developing section, the CPU 1 disconnects the bias power source 3 from the third-color developing section in order to interrupt the bias application to the developing section (steps S214 and S215).

Subsequently, the CPU 1 switches the third-color developing section to the first-color developing section. The CPU 1 reads data relating to the first-color bias voltage assigned to the developing roller of the first-color developing section, e.g., the color information and other developing conditions out of the memory 2, sets, based on the data, the bias voltage and frequency assigned to the first-color developing section, and then determines whether or not they are adequate (steps S204 and S205). If the answer of the step S205 is YES, the CPU 1 connects the bias voltage source 3 to the first-color developing section (steps S206 and S207). If the answer of the step S213 is NO, the CPU 1 determines whether or not the writing operation should be continued (step S216). If the answer of the step S216 is YES, the CPU 1 again sets up the bias application to the third-color developing section after the sensor 8 has sensed the mark 7 (steps S208 through S212). If the answer of the step S216 is NO, the CPU 1 disconnects the bias power source 3 from the third-color developing section (steps S217 and S218) while stopping the drive of the drum, belt, and developing roller (step S219).

Also, the CPU 1 reads data relating to the fourth-color bias voltage assigned to the developing roller of the fourth-color developing section, e.g., the color information and other developing conditions out of the memory 2 and determines, based on the data, whether or not the developing section being driven is valid (steps S202 and S203). If the answer of the step 202 is YES, the CPU 1 sets the bias voltage and frequency assigned to the fourth-color developing section and then determines whether or not they are adequate (steps S204 and S205). Subsequently, the CPU 1 connects the bias power source 4 to the fourth-color developing section (steps S206 and S207). When the second writing step of the second image forming unit begins at a time $t_{33}$, the CPU 1 turns on the bias application to the fourth-color developing section a time $t_{34}$. When the second writing step ends at a time $t_{38}$ on the elapse of the period of time corresponding to the duration of development, the CPU 1 interrupts the bias application to the fourth-color developing section. At a time $t_{40}$, the CPU 1 invalidates the operation of the fourth-color developing section and turns off the fourth color sensor switching signal (steps S208 through S212). Thereafter, the CPU 1 determines whether or not the fourth-color developing section should be replaced with another valid developing section (step S213). If the fourth-color switching section should be switched to the second-color developing section, the CPU 1 disconnects the bias power source 4 from the fourth-color developing section (steps S214 and S215).

Subsequently, the CPU 1 switches the fourth-color developing section to the second-color developing section. The CPU 1 reads data relating to the second-color bias voltage assigned to the developing roller of the second-color developing section, e.g., the color information and other developing conditions out of the memory 2, sets, based on the data, the bias voltage and frequency assigned to the second-color developing section, and then determines whether or not they are adequate (steps S204 and S205). If the answer of the step S205 is YES, the CPU 1 connects the bias voltage source 4 to the second-color developing section (steps S206 and S207). If the answer of the step S213 is NO, the CPU 1 determines whether or not the writing operation should be continued (step S216). If the answer of the step S216 is YES, the CPU 1 again sets up the bias application to the fourth-color developing section after the sensor 8 has sensed the mark 7 (steps S208 through S212). If the answer of the step S216 is NO, the CPU 1 disconnects the bias power source 4 from the fourth-color developing section (steps S217 and S218) while stopping the drive of the drum, belt, and developing roller (step S219). By the above procedure, the entire development in the first color to the fourth color is completed.

As stated above, in the illustrative embodiment, a single bias power source is assigned to each of the two image forming unit and has its bias voltage so switched as to selectively render the developer deposited on each developing roller operative or inoperative. This, coupled with the fact that the bias voltage is variable in matching relation to a color, obviates the need for sophisticated control over the developer and reduces the overall size of the apparatus.

While the illustrative embodiment assigns a particular bias power source to each image forming unit, a single bias power source may be shared by two image forming units if an arrangement is made to switch the application of a bias voltage from the power source to the image forming sections of the image forming units.

Various modifications will become possible for those skilled in the art after receiving the teachings of the present disclosure without departing from the scope thereof.

What is claimed is:

1. An image forming apparatus, comprising:

a plurality of image forming units each including a single image carrier;

a single writing means and a plurality of developing means each including a single developing roller for developing a latent image formed on said single image carrier by said single writing means with a developer to thereby produce a toner image, said plurality of image forming units being spaced by a preselected distance along a same surface of an intermediate image transfer belt to which said toner image is to be transferred from said image carrier;

selecting means for selectively causing said plurality of developing means to perform development;

a single bias applying means for applying a bias voltage for development to said plurality of developing means; and bias switching means for applying the bias voltage output from said single bias applying means to one of said plurality of developing means selected by said selecting means, wherein said selecting means operates in response to outputs of sensors respectively included in said plurality of image forming units for sensing a switching between said developing means.

2. The apparatus as claimed in claim 1, wherein the bias voltage for development comprises a DC component with an AC component superposed thereon.

3. The apparatus as claimed in claim 2, wherein a particular AC component is assigned to each of said plurality of developing means.

4. The apparatus as claimed in claim 1, wherein said selecting means operates on the basis of one of a presence and an absence of image data to be provided to said developing means.

5. In an image forming apparatus comprising a plurality of image forming units each including a single image carrier, a single writing means and a plurality of developing means each including a single developing roller for developing a latent image formed on said single image carrier by said single writing means with a developer to thereby produce a toner image, said plurality of image forming units being spaced by a preselected distance along a surface of an intermediate image transfer belt to which said toner image is to be transferred from said image carrier, and selecting means for selectively causing said plurality of developing means to perform development, said plurality of image forming units each comprising:

a single bias applying means for applying a bias voltage for development to said plurality of developing means; and bias switching means for applying the bias voltage output from said single bias applying means to one of said plurality of developing means selected by said selecting means, wherein said selecting means operates in response to outputs of sensors respectively included in said plurality of image forming units for sensing a switching between said developing means.

6. The apparatus as claimed in claim 5, wherein the bias voltage for development comprises a DC component with an AC component superposed thereon.

7. The apparatus as claimed in claim 6, wherein a particular AC component is assigned to each of said plurality of developing means.

8. The apparatus as claimed in claim 5, wherein said selecting means operates on the basis of one of a presence and an absence of image data to be provided to said developing means.

9. In an image forming apparatus comprising a plurality of image forming units each including a single image carrier, a single writing means, a single bias applying means for applying a bias voltage for development, a plurality of developing means each being assigned to a particular color, for executing color-by-color development with said plurality of developing means of said plurality of image forming unit, and selecting means for selectively causing said plurality of developing means to perform development, a method of applying said bias voltage from said bias applying means to said developing means, comprising the steps of:

varying an output of said bias applying means to a bias voltage assigned to one of said developing means to perform development;

applying a varied bias voltage to said one of said developing means; and operating said selecting means in response to outputs of sensors respectively included in said plurality of image forming units for sensing a switching between said developing means.

10. In an image forming apparatus comprising a plurality of image forming units each including a single image carrier, a single writing means, a single bias applying means for applying a bias voltage for development, and a plurality of developing means each being assigned to a particular color, for executing color-by-color development with said plurality of developing means of said plurality of image forming units, and selecting means for selectively causing said plurality of developing means to perform development, a method of applying said bias voltage from said bias applying means to said developing means, comprising the steps of:

setting, based on data including a developing condition, a bias voltage matching with one of said developing means to perform development; and applying said bias voltage to said one of said developing means; and operating said selecting means in response to outputs of sensors respectively included in said plurality of image forming units for sensing a switching between said developing means.

11. An image forming apparatus, comprising:

a plurality of image forming units each including a single image carrier;

a single writing device and a plurality of developing devices each including a single developing roller configured to develop a latent image formed on said single image carrier by said single writing device with a developer to thereby produce a toner image, said plurality of image forming units being spaced by a preselected distance along a same surface of an intermediate image transfer belt to which said toner image is to be transferred from said image carrier;

a selecting device configured to selectively cause said plurality of developing devices to perform development;

a single bias applying device configured to apply a bias voltage for development to said plurality of developing devices; and a bias switching device configured to apply the bias voltage output from said single bias applying device to one of said plurality of developing devices selected by said selecting device, wherein said selecting device is configured to operate in response to outputs of sensors respectively included in said plurality of image forming units and configured to sense a switching between said developing devices.

12. The apparatus as claimed in claim 11, wherein the bias voltage for development comprises a DC component with an AC component superposed thereon.

13. The apparatus as claimed in claim 12, wherein a particular AC component is assigned to each of said plurality of developing devices.

14. The apparatus as claimed in claim 11, wherein said selecting device is configured to operate on the basis of one of a presence and an absence of image data to be provided to said developing devices.

15. In an image forming apparatus comprising a plurality of image forming units each including a single image carrier, a single writing device and a plurality of developing devices each including a single developing roller and configured to develop a latent image formed on said single image carrier by said single writing device with a developer to thereby produce a toner image, said plurality of image forming units being spaced by a preselected distance along a surface of an intermediate image transfer belt to which said toner image is to be transferred from said image carrier, and a selecting device configured to selectively cause said plurality of developing devices to perform development, said plurality of image forming units each comprising:

a single bias applying device configured to apply a bias voltage for development to said plurality of developing devices; and a bias switching device configured to apply the bias voltage output from said single bias applying device to one of said plurality of developing devices selected by said selecting device, wherein said selecting device is configured to operate in response to outputs of sensors respectively included in said plurality of image forming units and configured to sense a switching between said developing devices.

16. The apparatus as claimed in claim 15, wherein the bias voltage for development comprises a DC component with an AC component superposed thereon.

17. The apparatus as claimed in claim 16, wherein a particular AC component is assigned to each of said plurality of developing devices.

18. The apparatus as claimed in claim 15, wherein said selecting device is configured to operate on the basis of one of a presence and an absence of image data to be provided to said developing devices.

* * * * *